US009115594B2

(12) United States Patent
Krautheim

(10) Patent No.: US 9,115,594 B2
(45) Date of Patent: Aug. 25, 2015

(54) COMPRESSOR CASING TREATMENT FOR GAS TURBINE ENGINE

(75) Inventor: Michael S. Krautheim, Fountaintown, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 578 days.

(21) Appl. No.: 13/334,586

(22) Filed: Dec. 22, 2011

(65) Prior Publication Data

US 2012/0163967 A1 Jun. 28, 2012

Related U.S. Application Data

(60) Provisional application No. 61/427,702, filed on Dec. 28, 2010.

(51) Int. Cl.

| | |
|---|---|
| ***F01D 11/10*** | (2006.01) |
| ***F01D 11/12*** | (2006.01) |
| ***F04D 29/52*** | (2006.01) |

(52) U.S. Cl.

CPC ..... *F01D 11/10* (2013.01); *F01D 11/12* (2013.01); *F04D 29/526* (2013.01); *F05D 2240/10* (2013.01); *Y10T 29/49323* (2013.01)

(58) Field of Classification Search

USPC ..... 415/58.5, 58.4, 58.6, 58.7, 54.1, 52.1, 415/57.3, 57.1, 171.1; 416/179, 192

See application file for complete search history.

(56) References Cited

U.S. PATENT DOCUMENTS

| | | | | |
|---|---|---|---|---|
| 3,575,523 | A * | 4/1971 | Gross, Jr. | 415/171.1 |
| 5,282,718 | A | 2/1994 | Koff et al. | |
| 5,308,225 | A | 5/1994 | Koff et al. | |
| 5,431,533 | A | 7/1995 | Hobbs | |
| 5,474,417 | A * | 12/1995 | Privett et al. | 415/58.5 |
| 5,562,404 | A | 10/1996 | Koff et al. | |
| 5,607,284 | A | 3/1997 | Byrne et al. | |
| 6,402,458 | B1 | 6/2002 | Turner | |
| 6,585,479 | B2 | 7/2003 | Torrance | |
| 6,619,909 | B2 | 9/2003 | Barnett et al. | |
| 7,074,006 | B1 | 7/2006 | Hathaway et al. | |
| 7,270,519 | B2 * | 9/2007 | Wadia et al. | 416/236 R |
| 2006/0198726 | A1 | 9/2006 | Schirle et al. | |
| 2008/0206040 | A1 * | 8/2008 | Seitz | 415/57.3 |
| 2009/0290974 | A1 * | 11/2009 | Bayere et al. | 415/58.5 |
| 2009/0317232 | A1 * | 12/2009 | Guemmer | 415/58.5 |

FOREIGN PATENT DOCUMENTS

| | | | |
|---|---|---|---|
| EP | 0497574 | A1 | 8/1992 |
| WO | 9510692 | A1 | 4/1995 |

* cited by examiner

*Primary Examiner* — Nathaniel Wiehe
*Assistant Examiner* — Michael Sehn
(74) *Attorney, Agent, or Firm* — Krieg DeVault LLP

(57) ABSTRACT

An axial flow compressor for a gas turbine engine is disclosed having a casing treatment that includes a shrouded rotor and an airflow member disposed in a passage between a casing and the shrouded rotor. In one form the airflow member is stationary with the casing and in another the airflow member is coupled to rotate with the shrouded rotor. The airflow member can have an airfoil shape in some embodiments. A passage inlet that extracts working fluid and provides it to the passage can be formed between a leading edge of the rotor and a trailing edge. A passage outlet can be formed upstream of the leading edge of the rotor.

19 Claims, 4 Drawing Sheets

Meridiandl

COMPRESSOR CASING TREATMENT FOR GAS TURBINE ENGINE

RELATED APPLICATIONS

The present application claims the benefit of U.S. Provisional Patent Application No. 61/427,702 filed Dec. 28, 2010 which is incorporated herein by reference

TECHNICAL FIELD

The present invention generally relates to gas turbine engine compressors, and more particularly, but not exclusively, to axial compressors used in gas turbine engines.

BACKGROUND

Improving operability and performance of gas turbine engine axial flow compressors using casing treatments remains an area of interest. Some existing systems have various shortcomings relative to certain applications. Accordingly, there remains a need for further contributions in this area of technology.

SUMMARY

One embodiment of the present invention is a unique casing treatment for a gas turbine engine. Other embodiments include apparatuses, systems, devices, hardware, methods, and combinations for axial flow compressor casing treatments. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
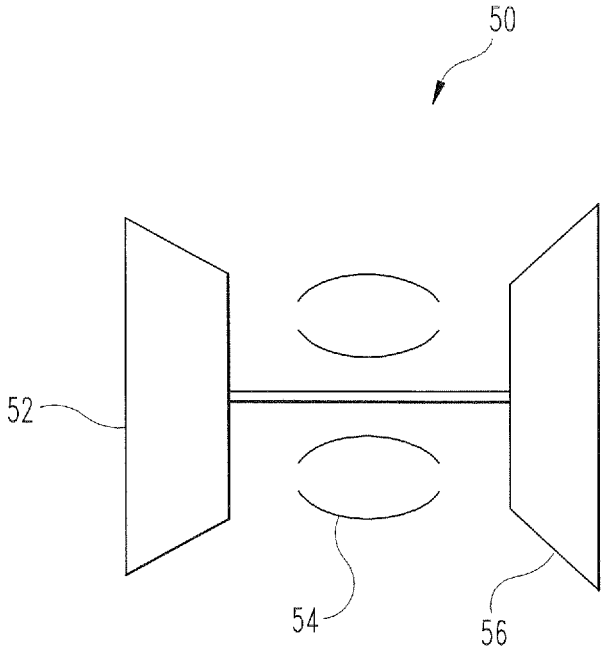
FIG. 1 depicts one form of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, one form is depicted of a gas turbine engine 50 useful as a powerplant for an aircraft. As used herein, the term "aircraft" includes, but is not limited to, airplanes, unmanned space vehicles, fixed wing vehicles, variable wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

One form of the gas turbine engine 50 includes a compressor 52, combustor 54, and turbine 56. The gas turbine engine 50 can take the form of an axial flow engine, but other forms are also contemplated. In just one non-limiting example, the gas turbine engine 50 can be a mixed axial/centrifugal flow engine. In some embodiments the gas turbine engine 50 can take the form of an adaptive cycle or variable cycle engine. The gas turbine engine 50 can be a turbojet or turbofan engine, among other possible engine types.

Figure 2:
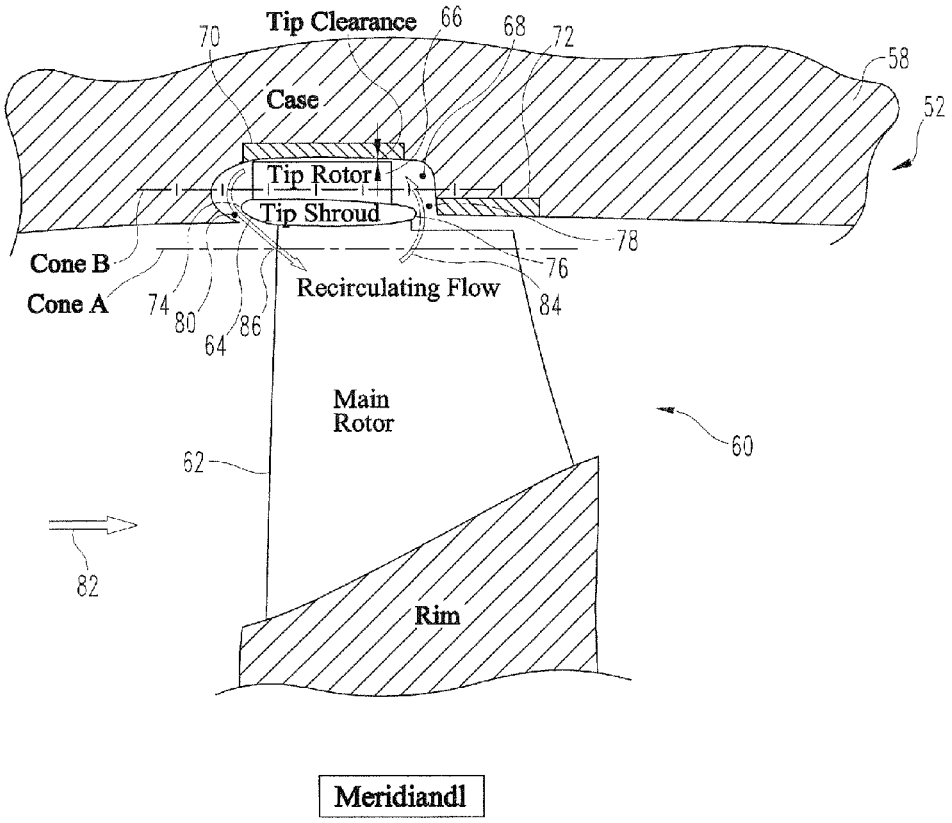
FIG. 2 depicts one form of a shrouded rotor having a casing treatment.

Turning now to FIG. 2, a portion of the compressor 52 is shown. In the illustrative form the compressor 52 is an axial flow compressor and includes a compressor casing 58 that encloses a main rotor 60 having blades 62, a shroud 64 disposed at the end of the blades 62, and an airflow member 66 disposed within a passage 68 formed between the compressor casing 58 and shroud 64. A flow of working fluid 82 is compressed by the blade 62 and a passage inlet portion 84 is extracted from the working fluid 82 and routed through the passage 68 to be re-injected as a passage outlet portion 86. In one form the working fluid is air. A re-circulating flow can be provided by a working fluid that flows from the passage inlet portion 84 to the passage outlet portion 86 and through the blades 62.

The compressor casing 58 of the compressor 52 includes a portion having an annular shape that forms part of a working fluid flow path through the gas turbine engine 50. In some forms the compressor casing 58 can be coupled with structure located radially inward from the casing 58 and that forms part of the working fluid flow path through the gas turbine engine 50. In some embodiments the compressor casing 58 can be segmented and can be made from a variety of materials.

In one form the compressor casing 58 includes abradable sections 70 and 72 which are designed to deteriorate when engaged with a moving portion of the gas turbine engine 50, such as a tip of the blade 62. Though the illustrative embodiment includes abradable sections 70 and 72 affixed to the casing 58, other embodiments include abradable sections at the ends of moving portions such as, but not limited to, the blades 62. Though in some embodiments the compressor casing 58 includes only one of the abradable sections 70 and 72, in other embodiments the compressor casing 58 may not have either abradable sections 70 and 72. The abradable sections 70 and 72 can be applied to the compressor casing 58 using a variety of techniques such as, but not limited to spray coating, and electroplating. In other embodiments, however, the abradable sections 70 and 72 can be mechanically coupled to the casing 58.

The main rotor 60 is operable to rotate the blades 62 at a variety of speeds to provide a compression of a working fluid for the gas turbine engine 50. The main rotor 60 and blades 62 can be made from a variety of materials and can be coupled together using a variety of techniques to form a rotating assembly. In some forms the blades 62 can be integrally formed with the main rotor 60.

The shroud 64 is disposed at the end of the blades 62 and located between the blades 62 and the airflow flow members 66. The shroud includes an axially forward portion 74 and an axially rearward portion 76. The terms "forward" and "rearward" are used herein for convenience of description and are not intended to imply the orientation of the respective portions relative to the gas turbine engine 50 and/or an aircraft with which the gas turbine engine 50 may be used. The axially forward portion 74 is depicted in the illustrative embodiment as extending forward of the blade 62 leading edge. In some embodiments, however, the axially forward portion 74 may not extend forward of the blade 62 leading edge. The axially rearward portion 76 is located at about the mid-chord position of the blade 62 but can take on different locations in other embodiments. The shroud 64 is coupled to the ends of the blades 62 and can take the form of a unitary structure in some embodiments or a segmented assembly in others. In some embodiments the shroud 64 can be formed integral with the blades 62.

The airflow member 66 is used to tangentially turn a flow of compressed working fluid traversing the passage 68, as will be discussed further hereinbelow. The airflow member 66 is disposed radially outward of the shroud 64. In the illustrative embodiment the airflow member 66 is coupled to the shroud 64 but in other embodiments can be coupled to the compressor casing 58 and thus remain stationary relative to a moving main rotor 60. The airflow member 66 can be formed integrally with the shroud in some embodiments, or can be coupled using a variety of techniques in other embodiments. Any number of airflow members 66 can be used within the passage 68. In some forms the number of airflow members 66 used in the passage 68 can be the same as the number of blades 62 of the main rotor 60. The airflow member 66 can be an airfoil shape in some embodiments.

The passage 68 conveys a compressed working fluid from a passage inlet 78 to a passage outlet 80. In some forms the passage 68 can have a relatively constant flow area between the passage inlet 78 and passage outlet 80. The passage inlet 78 is oriented rearward of the axially rearward portion 76 and forward of the trailing edge of the blade 62. In other embodiments, however, the passage inlet 78 can be located elsewhere relative to the axially rearward portion 76 and the trailing edge of the blade 62. The passage inlet 78 in the illustrated embodiment is defined by the compressor casing 58, the shroud 64, but in other embodiments can be defined by other structure of the gas turbine engine 50. The passage outlet 80 is located forward of the axially forward portion 74 of the shroud 64. The passage outlet 80 is defined by the shroud 64 and abradable section 72, but in other embodiments can be defined by other structure. To set forth just one non-limiting example, if the gas turbine engine 50 lacked an abradable section 70, the passage inlet 78 can be defined between the shroud 64 and the compressor casing 58.

Figure 3:
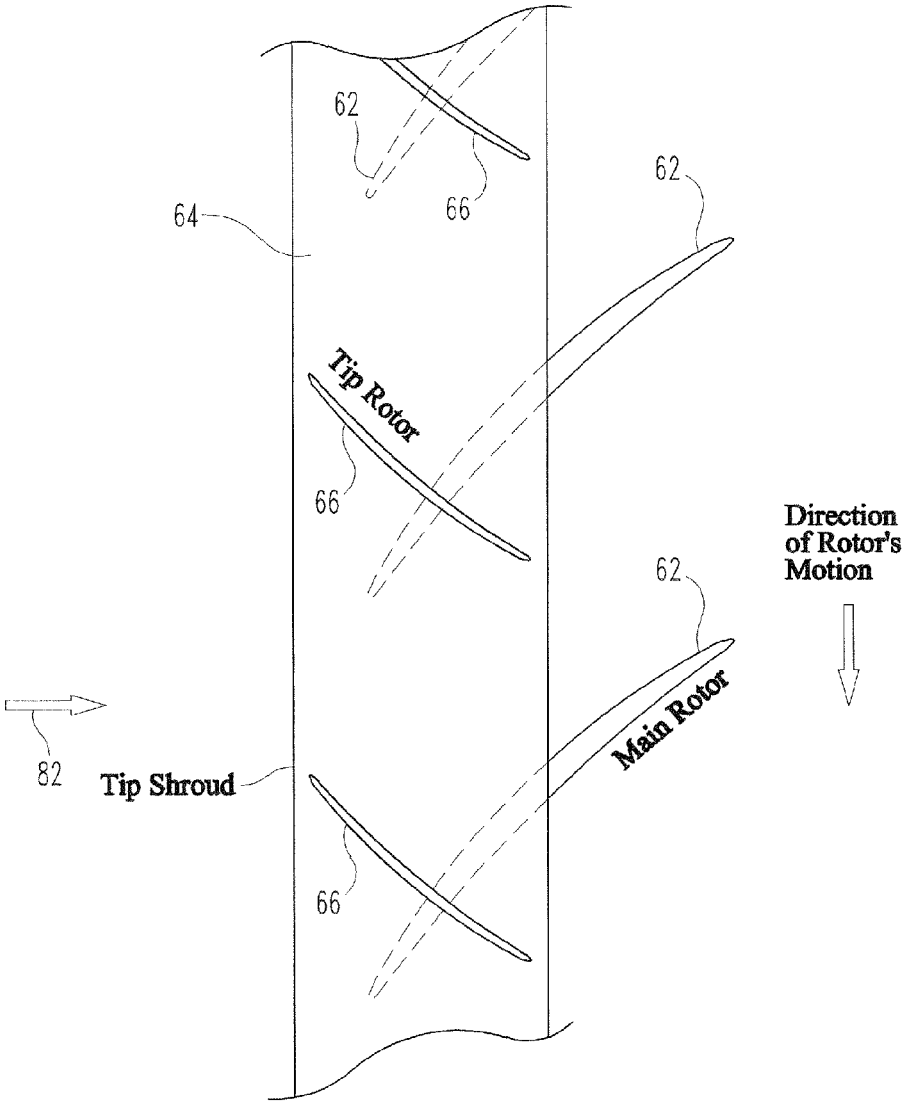
FIG. 3 depicts a view along the airflow member of FIG. 2 toward the shrouded rotor.

FIG. 3 depicts a view of an embodiment of the present application looking radially inward along the airflow member 66 and toward the blade 62. The direction of a flow of working fluid 82 that is acted upon by the blades 62 is shown, as is the direction of rotation of the blades 62. The compressor casing 58, passage inlet portion 84, and passage outlet portion 86, among other features, are not depicted in FIG. 3 for purposes of clarity.

Figure 4A:
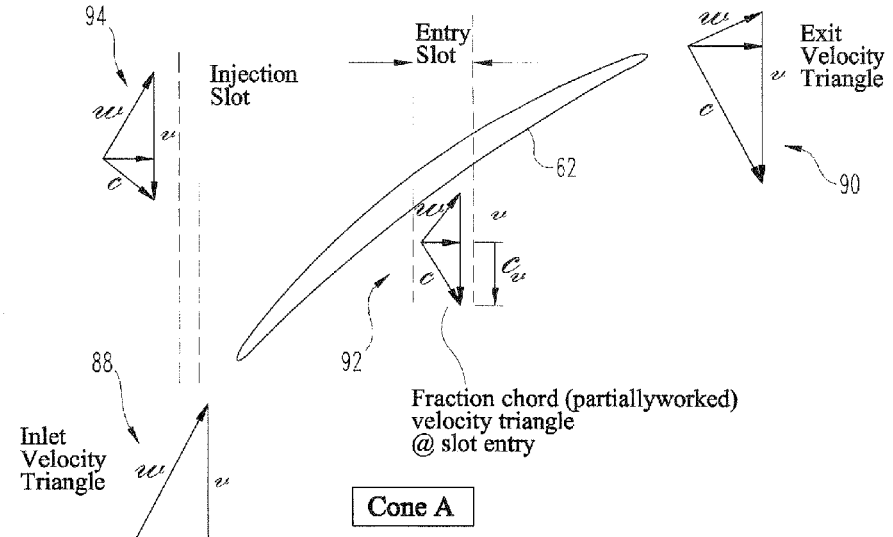
FIGS. 4*a* and 4*b* depicts velocity triangles of one form of the present application.
Figure 4B:
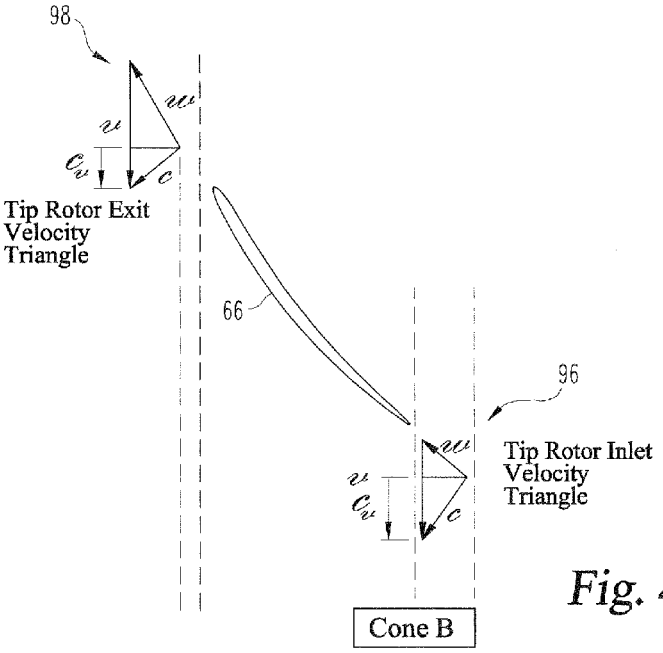

FIGS. 4*a* and 4*b* depict the blade 62, and airflow member 66, respectively, along with their respective velocity triangles to better illustrate the embodiment of the present application that includes the airflow member 66 coupled to the shroud 64. In FIG. 4*a*, a compressor inlet velocity triangle 88 and a compressor outlet velocity triangle 90 are shown. Also shown is the blade extraction velocity triangle 92 and blade injection slot velocity triangle 94. The blade extraction velocity triangle 92 corresponds to the velocity triangle at the passage inlet 78 and the blade injection slot velocity triangle 94 corresponds to the velocity triangle at the passage outlet 80. Each of the triangles includes an absolute velocity, c, relative velocity w, and rotation velocity U. The blade extraction velocity triangle 92 also includes $c_U$, the absolute tangential velocity, which will be used to compare to the airflow member velocity triangles in the discussion below. In FIG. 4*b*, an airflow member inlet velocity triangle 96 and airflow member outlet velocity triangle 98 are shown. The airflow member inlet velocity triangle 96 corresponds to the velocity triangle at the passage inlet 78 and the airflow member outlet velocity triangle 98 corresponds to the to the velocity triangle at the passage outlet 80. Also shown with the airflow member inlet velocity triangle 96 is $c_U$, the absolute tangential velocity.

As will be appreciated when comparing various aspects of the velocity triangles in FIG. 4*a*, the absolute velocity c is increased from the velocity triangle 88 to the velocity triangle 90 as work is imparted to the working fluid 82 through rotation of the blade 62. The increase in absolute velocity c as the working fluid flows along the blade 62 can also be seen in the blade extraction velocity triangle 92 relative to the compressor inlet velocity triangle 88 as a result of the working fluid being partially worked by the blade 62.

As the passage inlet portion 84 is extracted from the flow of working fluid 82 and turns to flow in a direction counter to the flow of working fluid 82, a number of observations can be made. When the flow is turned the absolute tangential velocity, $c_U$, maintains a relatively constant angular momentum, and is nearly constant for small radius change. If the flow area in the tip passage is such that the magnitude of the axial velocity is unchanged, and the assumption made that $c_U$ is changed insignificantly, then the airflow member inlet velocity triangle 96 is the mirror image of the blade extraction velocity triangle 92. As a result of the orientation of the airflow member 66 and the direction of working fluid flowing through the passage 68, the absolute tangential velocity $c_U$ is reduced across the airflow member 66. As a result of reducing absolute tangential velocity $c_U$, the Euler equation predicts a reduction in total temperature. The Euler equation can be expressed as $\Delta h=(U*c_{U2}-U*c_{U1})$, where h is specific enthalpy, $c_{U2}$ is the absolute axial velocity downstream of the airflow member 66, $c_{U1}$ is the absolute axial velocity upstream of the airflow member 66, and U the rotational speed of the rotor. Persons of skill in the field will appreciate that the thermodynamic result of a change in specific enthalpy is a corresponding decrease in total temperature. This result reduces and could conceivably eliminate the efficiency penalty of reworking the air through the passage 68.

One aspect of the present application provides an apparatus comprising a gas turbine engine compressor having a bladed rotor enclosed by a shroud and disposed within a portion of a compressor casing section, the bladed rotor having an upstream side and a downstream side, an airflow passage formed between the compressor casing section and the shroud, the airflow passage having an inlet and an outlet, the inlet located downstream relative to the outlet, and an airflow member disposed within the airflow passage.

Another aspect of the present application provides an apparatus comprising an axial compressor having a rotor including a plurality of blades and an air extraction portion and air insertion portion located on a tip side of the plurality of blades, a compressor shroud coupled to the ends of at least some of the plurality of blades, and an airfoil member coupled to the compressor shroud and operable to reduce an absolute tangential velocity of an airflow as the airflow traverses from the extraction portion to the insertion portion.

Yet another aspect of the present application provides an axial flow compressor of a gas turbine engine comprising a gas turbine engine compressor casing, a plurality of axial compressor blades operable to rotate at a velocity to provide a compression for the gas turbine engine, a shroud coupled to the ends of the plurality of axial compressor blades, a passage located between the shroud and the gas turbine engine compressor casing, and means for altering a velocity of an airflow that has been extracted from the plurality of blades and that is flowing through the passage during operation of the axial flow gas turbine engine compressor.

Still a further aspect of the present application provides a method comprising assembling an axial flow gas turbine engine casing, locating a bladed compressor rotor having a shroud within the axial flow gas turbine engine casing, and inserting a plurality of airflow members within a passage formed between the axial flow gas turbine engine casing and the shroud.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine compressor having a bladed rotor enclosed by an annular shroud and disposed within a portion of a compressor casing section, the bladed rotor having an upstream side and a downstream side, the annular shroud having an upstream end and a downstream end as referenced relative to a flow stream through the bladed rotor;

an airflow passage formed between the compressor casing section and the annular shroud, the airflow passage having an inlet defined by the downstream end of the annular shroud and an outlet defined by the upstream end of the annular shroud such that the inlet is located downstream to the outlet as referenced by the flow stream through the bladed rotor; and an airfoil-shaped airflow member attached to the shroud and disposed within the airflow passage, the airfoil-shaped airflow member oriented transverse to the bladed rotor thereby forming an angle between the airfoil-shaped airflow member and a neighboring blade of the bladed rotor such that as air enters from the inlet is turned to reduce an absolute tangential velocity of the air across the airfoil-shaped airflow member.

2. The apparatus of claim 1, wherein the inlet includes an opening located between the upstream side and the downstream side of the bladed rotor.

3. The apparatus of claim 1, wherein the outlet includes a flow path portion located upstream of the leading edge of the bladed rotor, and wherein the annular shroud covers the leading edge of the bladed rotor.

4. The apparatus of claim 3, wherein the annular shroud extends upstream of the leading edge of the bladed rotor and discourages the formation of leading edge tip vortices.

5. The apparatus of claim 1, wherein an upstream portion of the annular shroud defines a part of the outlet and a downstream portion of the annular shroud defines a part of the inlet.

6. The apparatus of claim 1, wherein the airflow member is operable to rotate with the bladed rotor.

7. The apparatus of claim 1, wherein the upstream end of the annular shroud extends further upstream than the upstream side of the bladed rotor.

8. The apparatus of claim 1, wherein the annular shroud extends past both trailing edge and leading edge of the airfoil-shaped airflow member.

9. The apparatus of claim 1, which further includes an abradable section operable to receive tip rubs during operation of the gas turbine engine compressor when the bladed rotor is rotated.

10. The apparatus of claim 1, wherein a working fluid traverses through the airflow passage from the inlet to the outlet, and wherein the airflow member is operable to extract work from the working fluid traversing the airflow passage.

11. An apparatus comprising:

an axial compressor having a rotor including a plurality of blades and an air extraction portion and air insertion portion located on a tip side of the plurality of blades;

an annular compressor shroud coupled to ends of the plurality of blades, the air extraction portion formed by a surface on an axially aft end of the compressor shroud, the air insertion portion formed by a surface on an axially forward end of the compressor shroud; and an airfoil member coupled to the compressor shroud and oriented in a crossing configuration to form an angle with one of the plurality of blades such that the airfoil member reduces an absolute tangential velocity of an airflow as the airflow traverses from the air extraction portion to the insertion portion.

12. The apparatus of claim 11, wherein the airflow is turned around a portion of the annular compressor shroud located intermediate an upstream end of a blade and a downstream end of the blade.

13. The apparatus of claim 11, wherein the airflow is turned around portion of the annular compressor shroud located upstream of an upstream end of a blade.

14. The apparatus of claim 11, wherein the airflow exiting the insertion portion is inserted upstream of a leading edge of a blade.

15. The apparatus of claim 11, wherein the rotor rotates toward a pressure side of the plurality of blades and toward a suction side of the airfoil member.

16. A method comprising:

assembling an axial flow gas turbine engine casing;

locating a bladed compressor rotor having an annular shroud within the axial flow gas turbine engine casing, the annular shroud having a first end and a second end and a plurality of airfoil-shaped airflow members attached to the annular shroud, the first end being an axially aft end and the second end being an axially forward end; and inserting the plurality of airfoil-shaped airflow members within a passage formed between the axial flow gas turbine engine casing and the shroud, wherein the inserting includes orienting the airflow members in a configuration that provides an angle between the airflow members and neighboring blades of the bladed compressor rotor, the angle providing a configuration that reduces an absolute tangential velocity of an airflow that passes through the passage, the airflow that passes through the passage enters around a first surface that forms the first end of the annular shroud and exits around a second surface that forms the second end of the annular shroud.

17. The method of claim 16, wherein the plurality of airflow members are coupled with the annular shroud such that the locating and the inserting occur simultaneously.

18. The method of claim 16, which further includes installing an abradable member between a blade and the axial flow gas turbine engine casing.

19. The method of claim 18, wherein the installing includes installing an abradable member between an airflow member and the axial flow gas turbine engine casing.

* * * * *